US012692850B2

(12) United States Patent
Lambert et al.

(10) Patent No.: US 12,692,850 B2
(45) Date of Patent: Jul. 28, 2026

(54) PORTABLE AIR PUMP AND INFLATOR SYSTEM WITH A VIBRATION DAMPING BASE

(71) Applicant: The Noco Company, Glenwillow, OH (US)

(72) Inventors: Stephen Lambert, Glenwillow, OH (US); Matthew Michael Bosway, Queen Creek, AZ (US)

(73) Assignee: The Noco Company, Glenwillow, OH (US)

( * ) Notice: Subject to any disclaimer, the term of this patent is extended or adjusted under 35 U.S.C. 154(b) by 0 days.

(21) Appl. No.: 18/925,200

(22) Filed: Oct. 24, 2024

(65) Prior Publication Data

US 2025/0137444 A1 May 1, 2025

Related U.S. Application Data

(60) Provisional application No. 63/593,678, filed on Oct. 27, 2023.

(51) Int. Cl.
*F04B 35/06* (2006.01)
*F04B 35/04* (2006.01)
(Continued)

(52) U.S. Cl.
CPC ..... *F04B 35/06* (2013.01); *F04B 35/04* (2013.01); *F04B 39/0022* (2013.01);
(Continued)

(58) Field of Classification Search
CPC ..... F04B 35/06; F04B 35/04; F04B 39/0022; F04B 39/0044; F04B 39/06;
(Continued)

(56) References Cited

U.S. PATENT DOCUMENTS 874,960 A 12/1907 Hamann
1,188,999 A 6/1916 Rose
(Continued)

FOREIGN PATENT DOCUMENTS

CN 201972885 9/2011
CN 103415422 11/2013
(Continued)

OTHER PUBLICATIONS

Patent Cooperation Treaty, PCT/US2024/052725, International Search Report and Written Opinion, Jan. 24, 2025.
(Continued)

*Primary Examiner* — Dominick L Plakkoottam
(74) *Attorney, Agent, or Firm* — Jones Day

(57) ABSTRACT

Systems and methods disclosed herein include a portable air pump and inflator system comprising an electric air compressor, a compressor housing enclosing the electric air compressor, an air hose attached or attachable to an air outlet of the electric air compressor, and a housing base attached to the compressor housing. The housing base comprises a rigid base portion that is attached to the compressor housing and a plurality of flexible foot extensions that extend from the rigid base portion. The flexible foot extensions are configured to support the portable air pump and inflator system on a surface and dampen vibrations caused by the operation of the electric air compressor.

16 Claims, 15 Drawing Sheets

(51) Int. Cl.
*F04B 39/00* (2006.01)
*F04B 39/06* (2006.01)
*F04B 39/10* (2006.01)
*F04B 39/12* (2006.01)

(52) U.S. Cl.
CPC ..... *F04B 39/0044* (2013.01); *F04B 39/06* (2013.01); *F04B 39/1073* (2013.01); *F04B 39/121* (2013.01)

(58) Field of Classification Search
CPC ..... F04B 39/1073; F04B 39/121; F04B 39/0005; F04B 39/0016; F04B 39/123
See application file for complete search history.

(56) References Cited

U.S. PATENT DOCUMENTS 1,694,218 A 12/1928 Hazard
4,618,099 A * 10/1986 Nagao ..... B05B 9/0861 239/378
5,520,519 A * 5/1996 Birkeland ..... F04B 41/02 417/63
9,458,845 B2 10/2016 White et al.
2004/0118940 A1* 6/2004 Lavitt ..... B05B 9/0861 239/302
2004/0223859 A1* 11/2004 Sharp ..... F04B 39/127 417/363
2008/0044296 A1* 2/2008 Wood ..... F04B 35/06 417/234
2009/0010774 A1* 1/2009 Fish ..... F04C 2/16 417/410.1
2010/0193054 A1* 8/2010 Hernandez ..... F04B 17/06 137/565.18
2015/0308425 A1* 10/2015 Skotty ..... F04B 35/04 417/63
2017/0146002 A1* 5/2017 Thackery ..... F04C 18/16
2017/0340356 A1* 11/2017 Presser ..... A61B 17/545
2022/0364554 A1 11/2022 Walmsley et al.
2023/0296112 A1 9/2023 Feng

FOREIGN PATENT DOCUMENTS

CN 208233019 12/2018
DE 185022 9/1905
WO WO 2016/060066 4/2016

OTHER PUBLICATIONS

Patent Cooperation Treaty, PCT/US2024/052720, International Search Report and Written Opinion, Mar. 7, 2025.

* cited by examiner

PORTABLE AIR PUMP AND INFLATOR SYSTEM WITH A VIBRATION DAMPING BASE

CROSS-REFERENCE TO RELATED APPLICATION

This application claims priority from U.S. Provisional Patent Application No. 63/593,678, filed on Oct. 27, 2023, the entirety of which is incorporated herein by reference.

FIELD

The present disclosure relates generally to a portable air pump (e.g., air compressor), and more particularly to a vibration damping base for damping vibrations of a portable air pump.

BACKGROUND

Vehicles such as automobiles, trucks, and buses require an air pump for providing pressured air, for example, for inflating the vehicle tires.

SUMMARY

Systems and methods disclosed herein include a portable air pump and inflator system comprising an electric air compressor, a compressor housing enclosing the electric air compressor, an air hose attached or attachable to an air outlet of the electric air compressor, and a housing base attached to the compressor housing. The housing base comprises a rigid base portion that is attached to the compressor housing and a plurality of flexible foot extensions that extend from the rigid base portion. The flexible foot extensions are configured to support the portable air pump and inflator system on a surface and dampen vibrations caused by the operation of the electric air compressor.

As another example, a housing base for a portable air pump and inflator system comprises a rigid base portion that is attached to or attachable to a compressor housing. A plurality of flexible foot extensions extend from the rigid base portion and are configured to support the portable air pump and inflator system on a surface. The flexible foot extensions define slots into which an air hose of the portable air pump and inflator system may be inserted. The flexible foot extensions dampen vibrations caused by an operation of the portable air pump and inflator system.

BRIEF DESCRIPTION OF THE DRAWINGS

The following detailed description will be better understood when read in conjunction with the appended drawings. For the purpose of illustration, there is shown in the drawings certain embodiments of the present disclosure. It should be understood, however, that the invention is not limited to the precise arrangements and instrumentalities shown. The accompanying drawings, which are incorporated in and constitute a part of this specification, illustrate an implementation of systems and apparatuses consistent with the present invention and, together with the description, serve to explain advantages and principles consistent with the invention.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

It is to be understood that the phraseology and terminology employed herein are for the purpose of description and should not be regarded as limiting. For example, the use of a singular term, such as, "a" is not intended as limiting of the number of items. Also the use of relational terms, such as but not limited to, "top," "bottom," "left," "right," "upper," "lower," "down," "up," "side," are used in the description for clarity and are not intended to limit the scope of the invention or the appended claims. Further, it should be understood that any one of the features can be used separately or in combination with other features. Other systems, methods, features, and advantages of the invention will be or become apparent to one with skill in the art upon examination of the detailed description. It is intended that all such additional systems, methods, features, and advantages be included within this description, be within the scope of the present invention, and be protected by the accompanying claims.

Portable air pumps and inflator systems may be used to inflate inflatable objects such as tires, balls used in sports, and rafts. Some portable air pumps and inflator systems include an air compressor that can cause vibrations during operation of the air pump and inflator system. The vibrations can cause the air pump and inflator system to move or may disrupt the inflation of the inflatable objects. Systems and methods disclosed herein include a vibration damping base that can reduce vibrations during operation of the air pump and inflator system, and that can facilitate convenient storage of certain accessories (e.g., air hose) of an air pump and inflator system.

Figure 1:
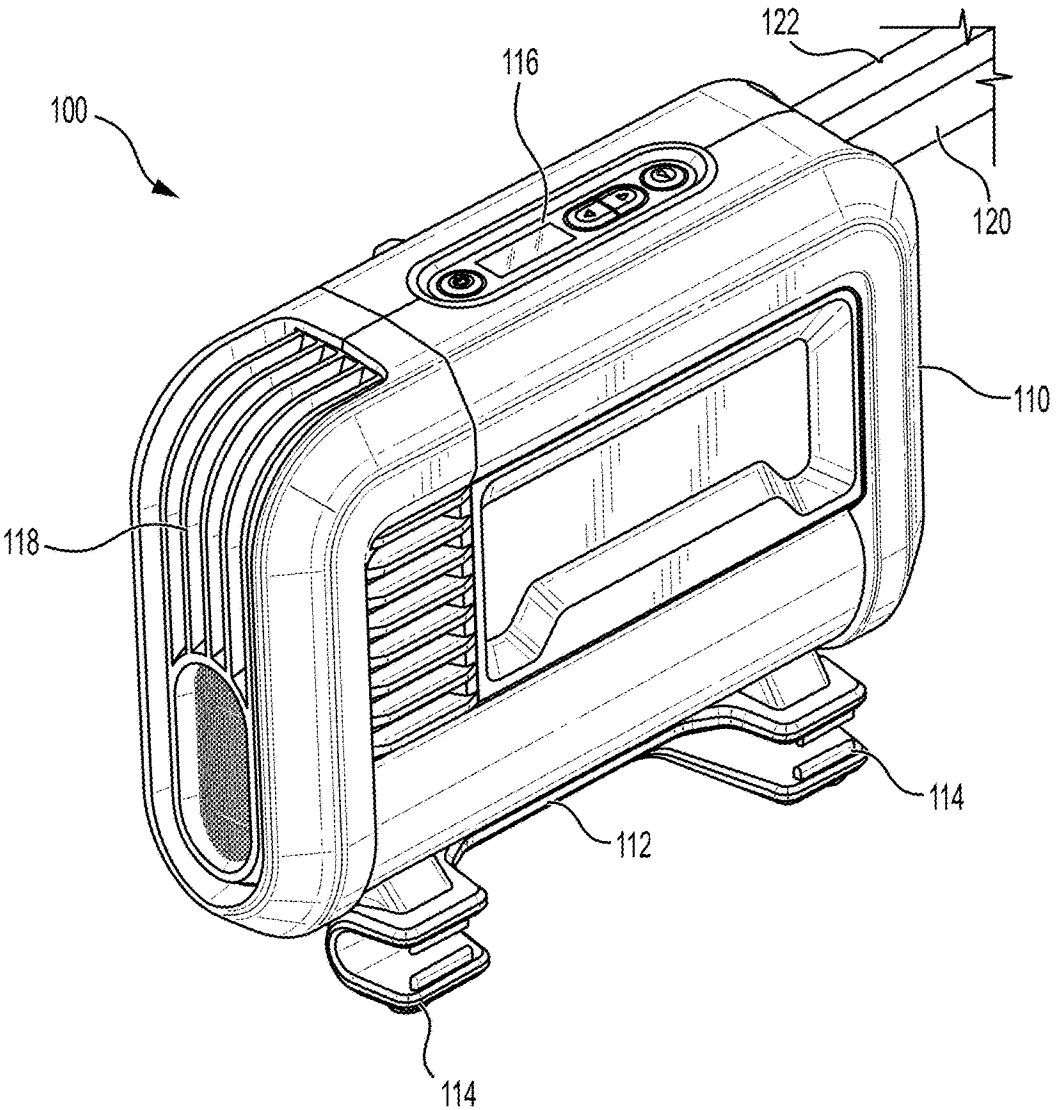
FIG. 1 depicts a perspective view of a portable air pump and inflator system, in accordance with some embodiments.
Figure 2:
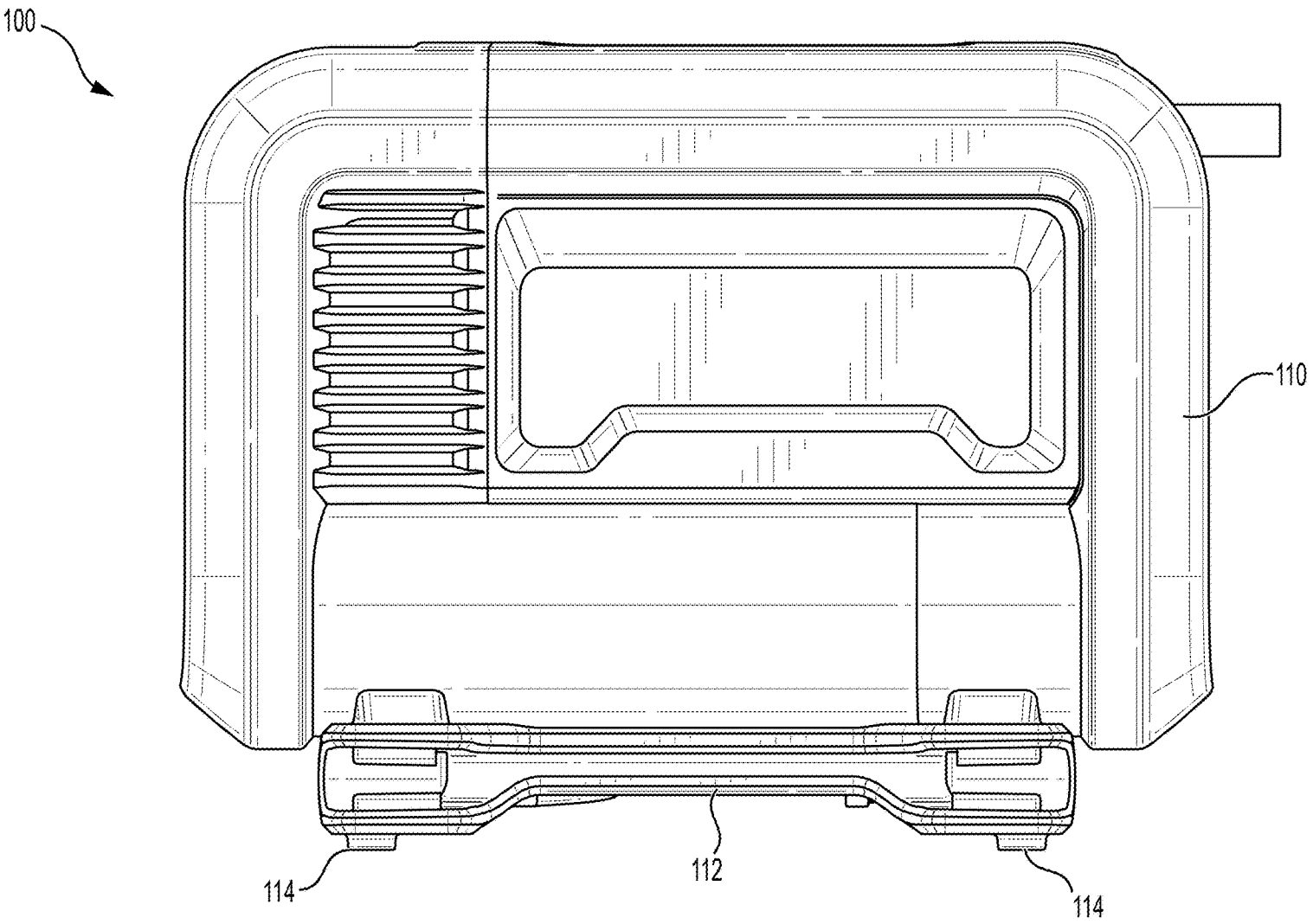
FIG. 2 depicts a front elevation view of a portable air pump and inflator system, in accordance with some embodiments.
Figure 3:
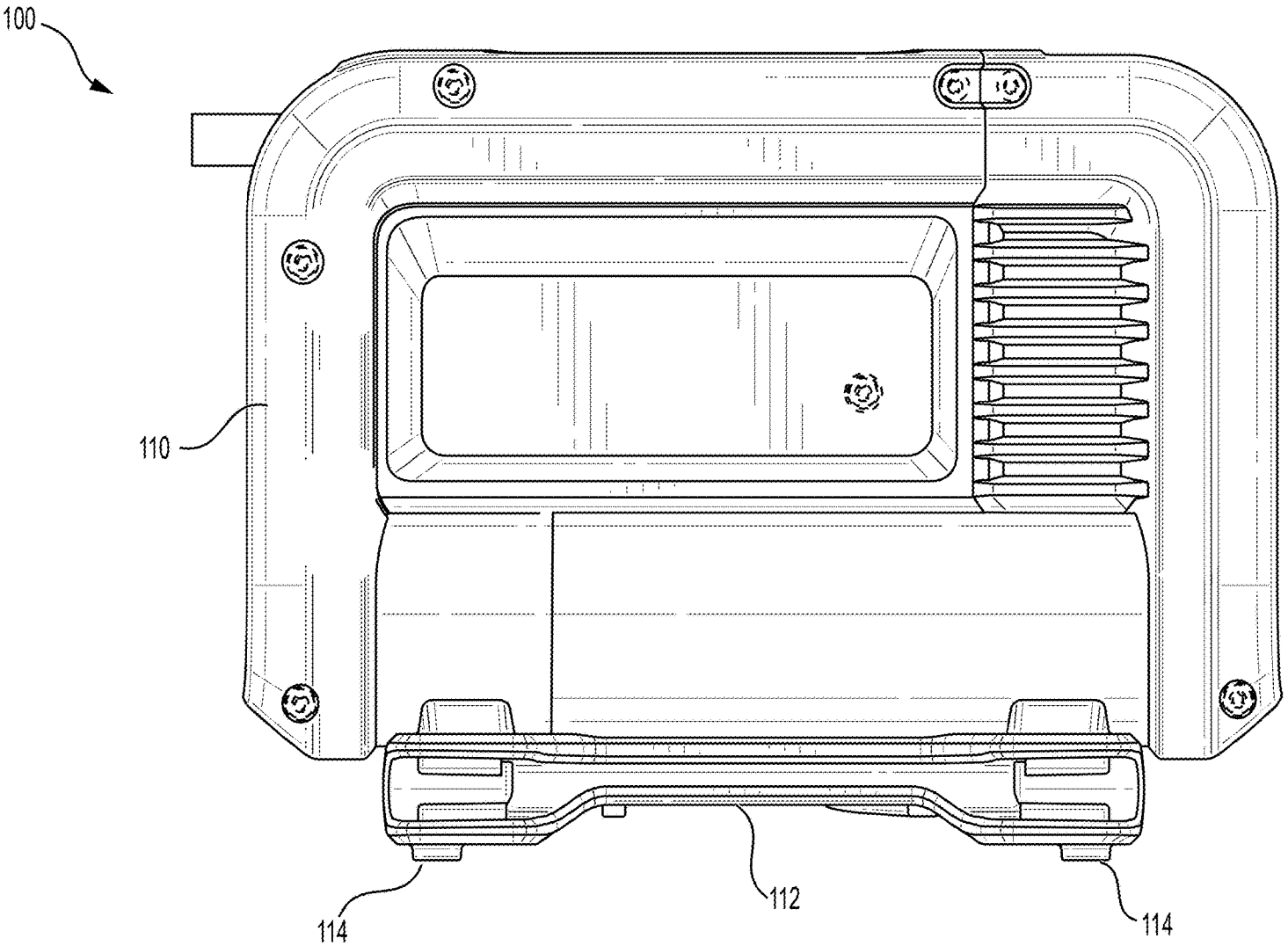
FIG. 3 depicts a back elevation view of a portable air pump and inflator system, in accordance with some embodiments.
Figure 4:
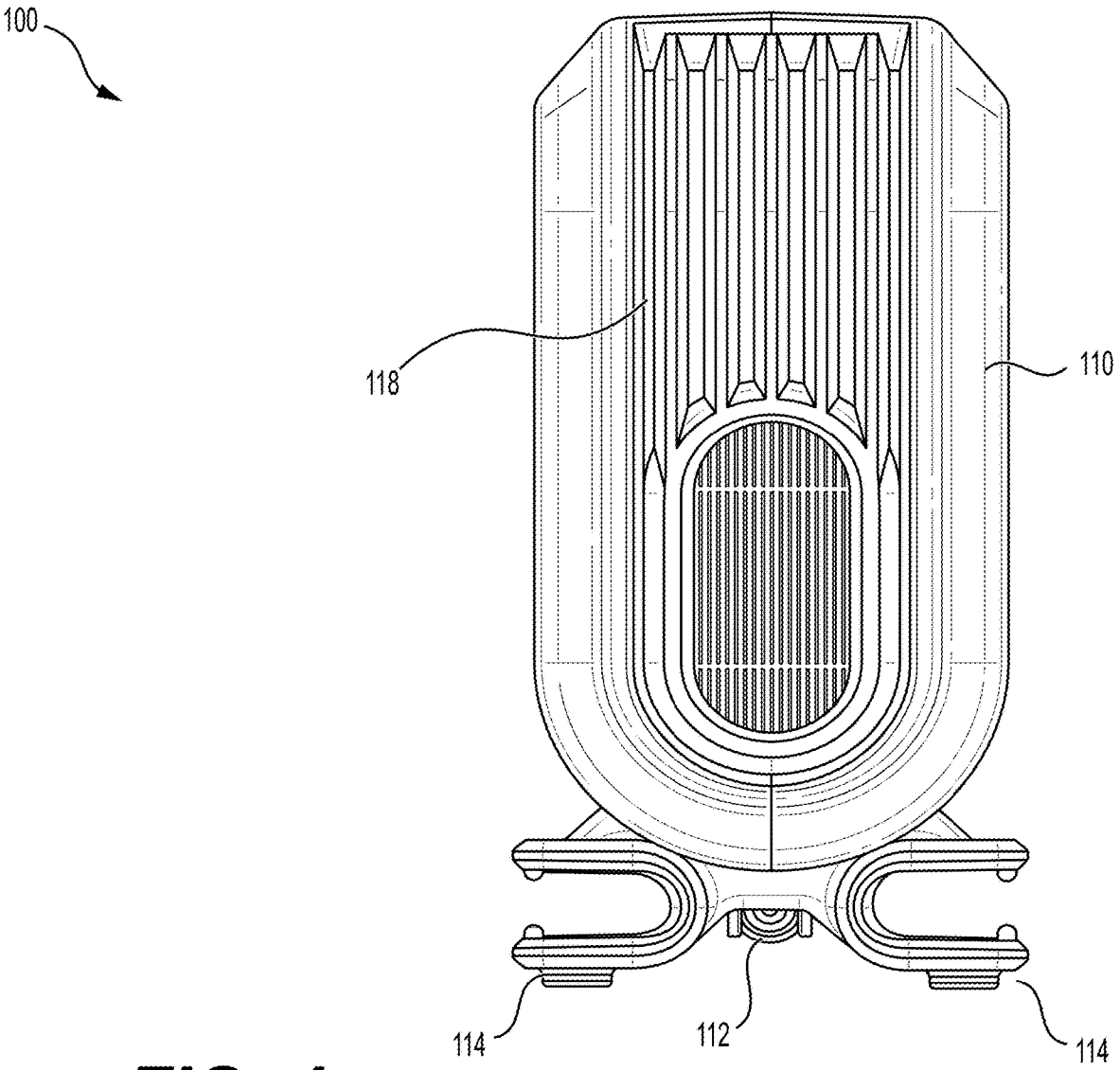
FIG. 4 depicts a left elevation view of a portable air pump and inflator system, in accordance with some embodiments.
Figure 5B:
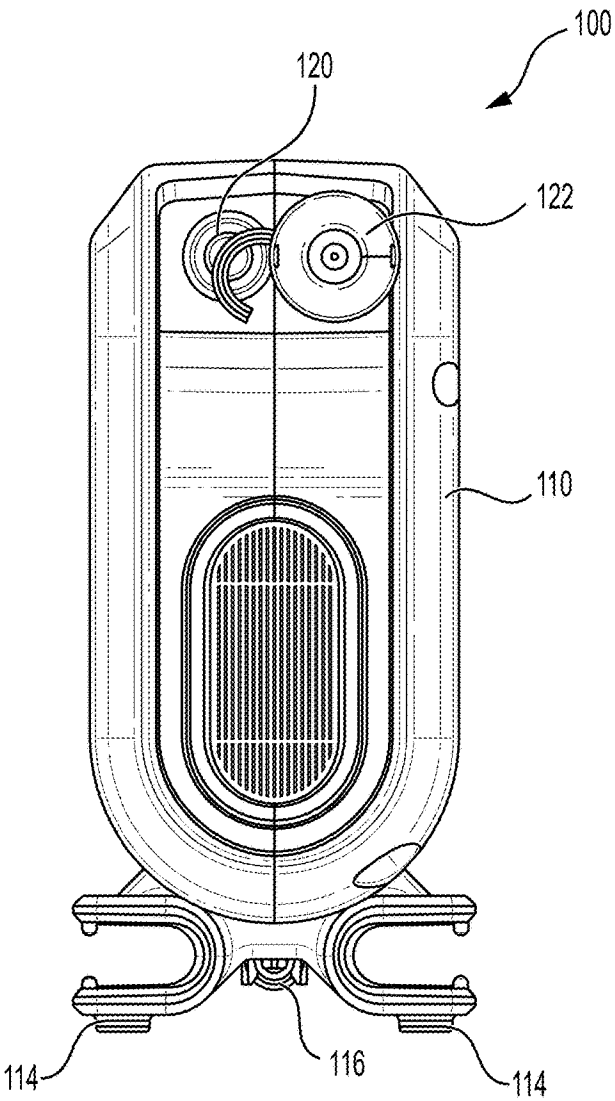
FIG. 5B depicts a right elevation view of a portable air pump and inflator system with a connected air hose and power cord, in accordance with some embodiments.
Figure 5A:
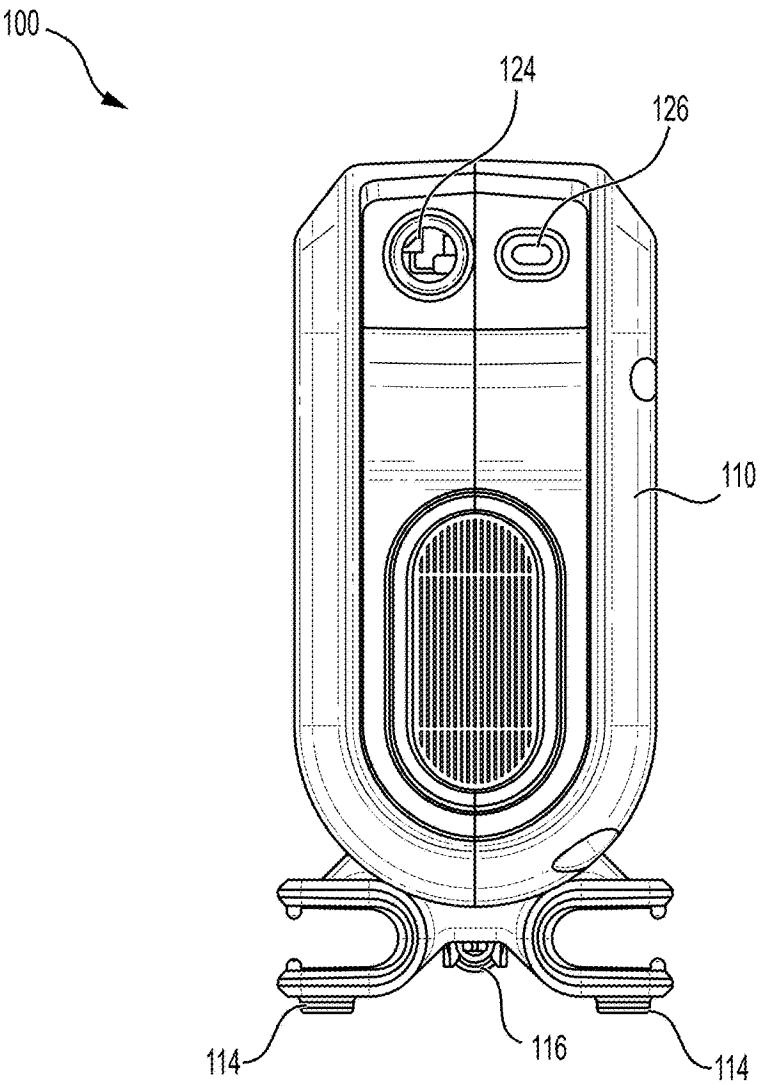
FIG. 5A depicts a right elevation view of a portable air pump and inflator system, in accordance with some embodiments.
Figure 6:
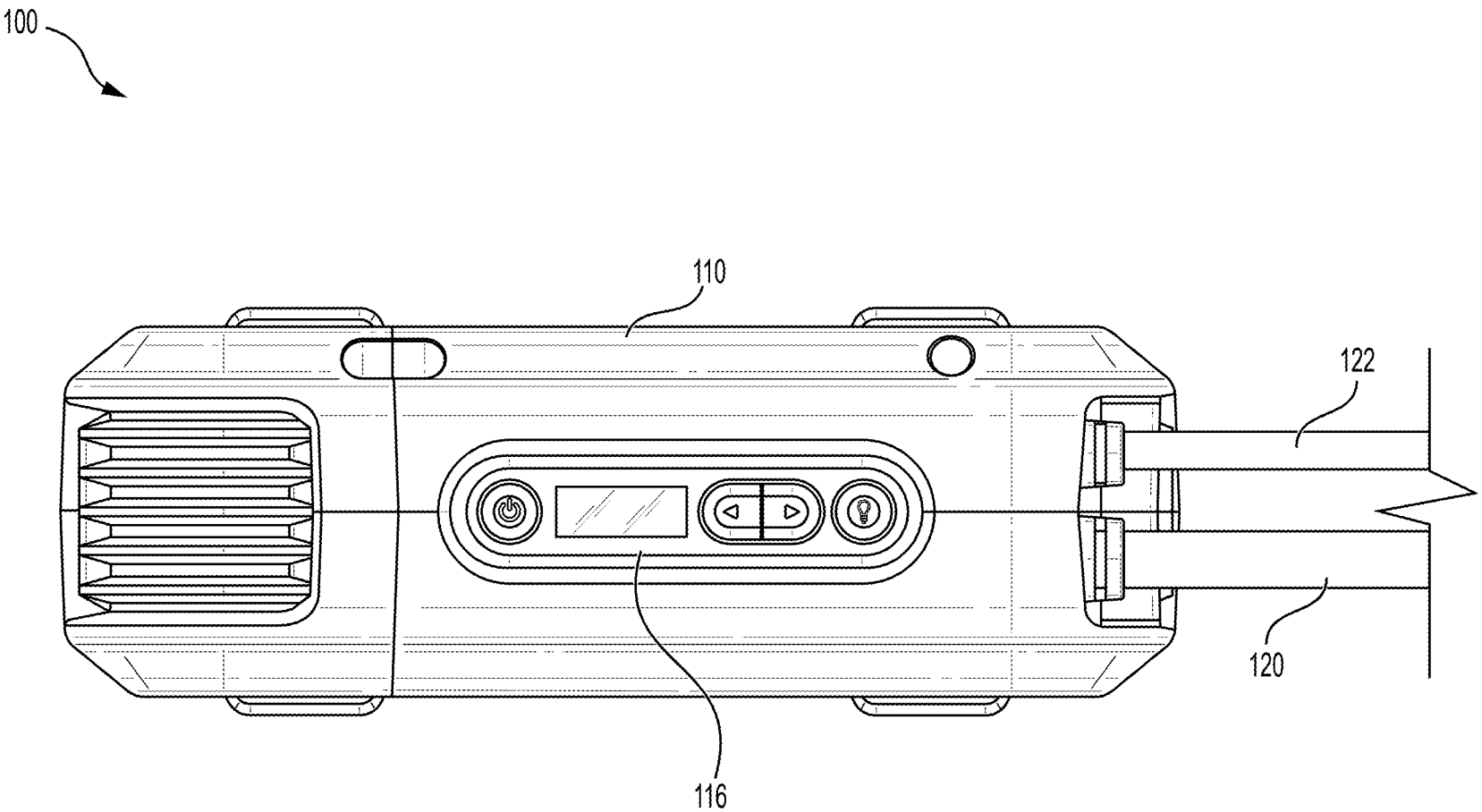
FIG. 6 depicts a top elevation view of a portable air pump and inflator system, in accordance with some embodiments.
Figure 7:
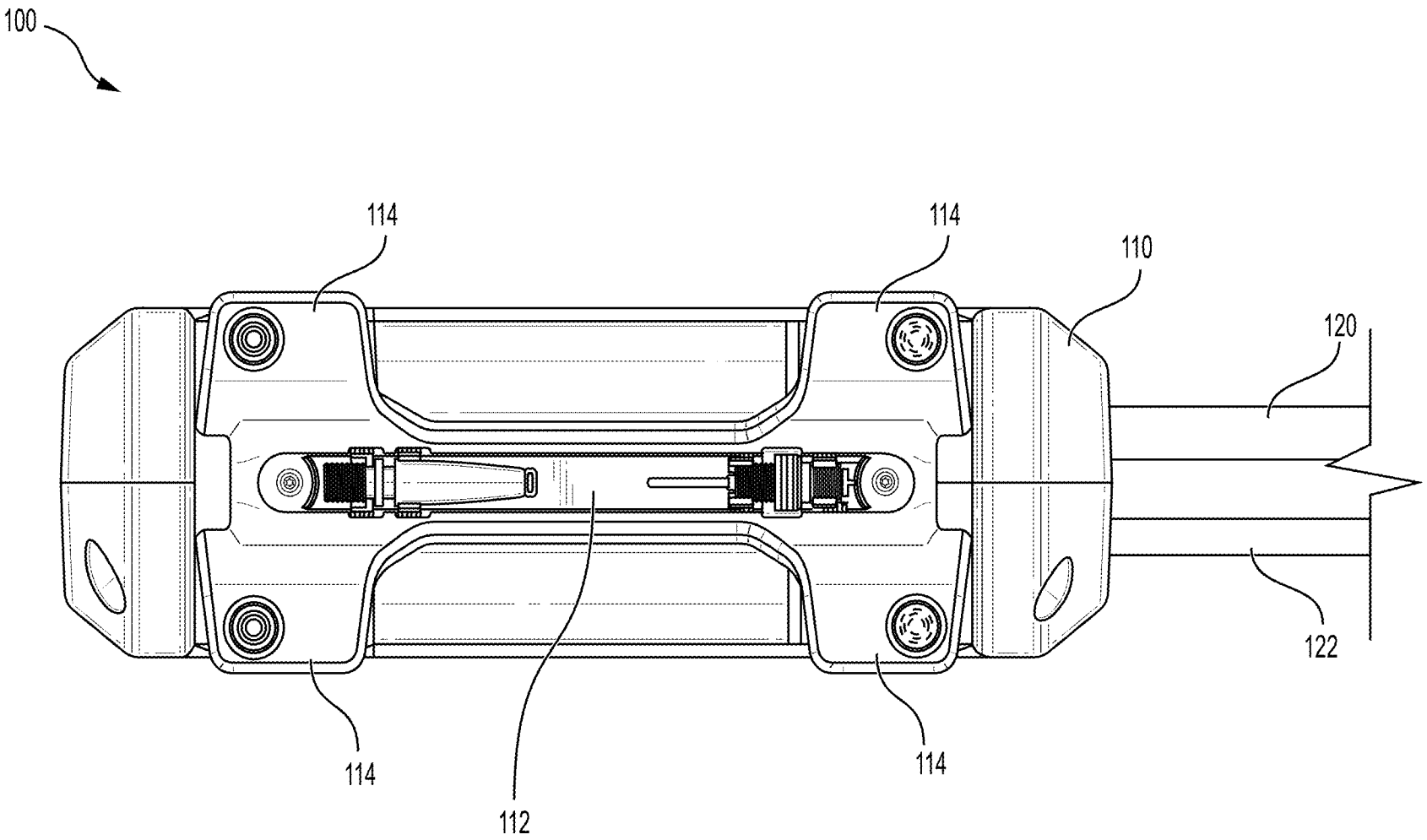
FIG. 7 depicts a bottom elevation view of a portable air pump and inflator system, in accordance with some embodiments.
Figure 8:
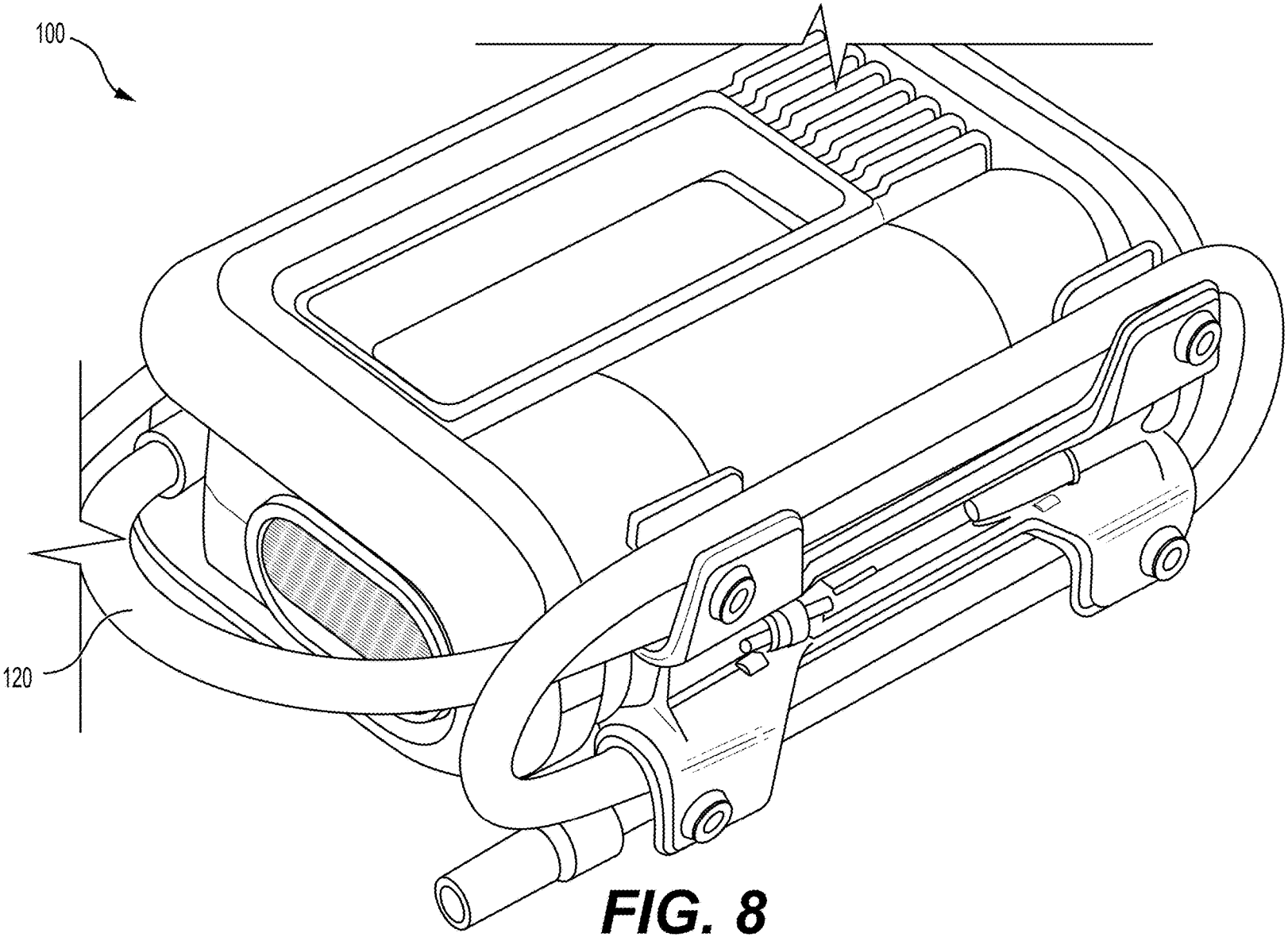
FIG. 8 depicts a perspective view of a portable air pump and inflator system showing an air hose wrapped around a base portion, in accordance with some embodiments.

FIGS. 1-8 show views of an example portable air pump and inflator system, in accordance with some embodiments. Specifically, FIG. 1 is a perspective view for an embodiment of a portable air pump and inflator system 100, FIG. 2 is a front elevation view thereof, FIG. 3 is a back elevation view thereof, FIG. 4 is a left elevation view thereof, FIGS. 5A and 5B are right elevation views thereof, FIG. 6 is a top elevation view thereof, FIG. 7 is a bottom elevation view thereof, and FIG. 8 is another perspective view for an embodiment of a portable air pump and inflator system showing an air hose wrapped around a base portion of the portable air pump. As shown in FIGS. 1-8, the portable air pump and inflator system 100 includes a compressor housing 110 that encloses an electric air compressor, and a housing base 112 that is attached to the compressor housing 110 and that includes a plurality of flexible foot extensions 114 for supporting the portable air pump and inflator system 100 on a surface. The housing base 112 may also define slots for securely winding an air hose around the portable air pump (as shown in FIG. 8). As shown in FIG. 4, the compressor housing 110 may include a rounded bottom portion that rests within the housing base 112.

The portable air pump and inflator system 100 may also include a user interface 116 (as shown in FIGS. 1 and 6), a heat sink 118 (as shown in FIGS. 1 and 4), an attached or attachable air hose 120 (as shown in FIGS. 6-8), and a power cord 122 (as shown in FIGS. 6 and 7). The user interface 116 may be coupled to a processing device (now shown) mounted within the compressor housing 110 that is configured to control operation of the portable air pump and inflator system 100. The user interface 116 may include a plurality of buttons for controlling the operation of the portable air pump and inflator system 100. For example, a power button within the user interface 116 may be configured to turn on and turn off the portable air pump and inflator system 100, and other buttons may control parameters of the portable air pump and inflator system 100 (e.g., the pressure to which the portable air pump and inflator system 100 inflates inflatable objects). The heat sink 118 may be configured to dissipate heat generated by the electric air compressor and the pressure relief system 200 (described below with respect to FIGS. 13A-C).

As shown in FIGS. 5A and 5B, the air hose 120 and/or the power cord 122 may be detachable from the compressor housing (e.g., for easy storage and replacement.) FIG. 5A shows examples of an air outlet port 124 to which the air hose 120 may be connected and a power port 126 to which the power cord 122 may be connected. FIG. 5B shows an example with the air hose 120 and power cord 122 connected to the respective ports 124, 126. The air outlet port 124 and the power port 126 may be adjacent to one another to facilitate an organized and convenient routing of wires to and from the portable air pump and inflator system 100. As shown in FIG. 6, the compressor housing 110 may include an indented portion at which the air hose 120 and the power cord 122 may be attached. The indented portion may provide room to accommodate attachment of plugs of the air hose 120 and power cord 122.

Vibration Damping Base

FIGS. 9-12 illustrate views of a housing base for a portable air pump and inflator system, in accordance with some embodiments. The illustrated housing base 112 may, for example, be utilized in the portable air pump and inflator system 100 shown in FIGS. 1-8 in order to provide vibration damping, hose storage, and/or accessory storage. For example, many known portable compressors will move on the surface on which they are placed (e.g., "walk") while the compressor is running, which may require the user to continually reposition the unit as it is being used. The housing base 112 embodiment shown in FIGS. 9-12 may be used to dampen vibrations, preventing this undesirable "walking" behavior. The illustrated housing base 112 comprises rubber over-molded plastic with the substrate removed in the areas in which the base makes contact with the ground. This allows the rubber to act as a damper and absorb the vibrations that would otherwise cause the unit to "walk."

Figure 9:
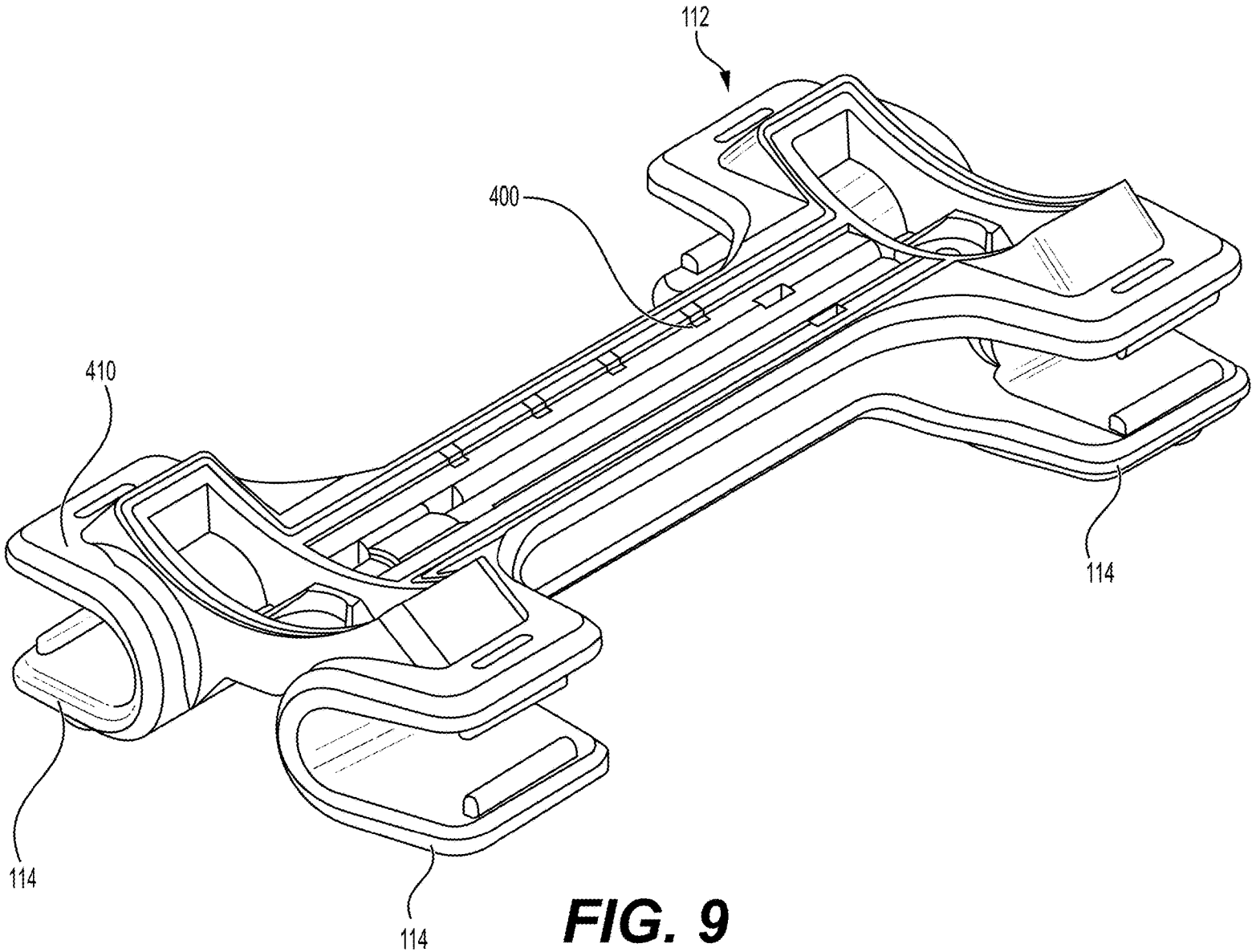
FIG. 9 depicts a perspective view of a housing base for a portable air pump and inflator system, in accordance with some embodiments.
Figure 10:
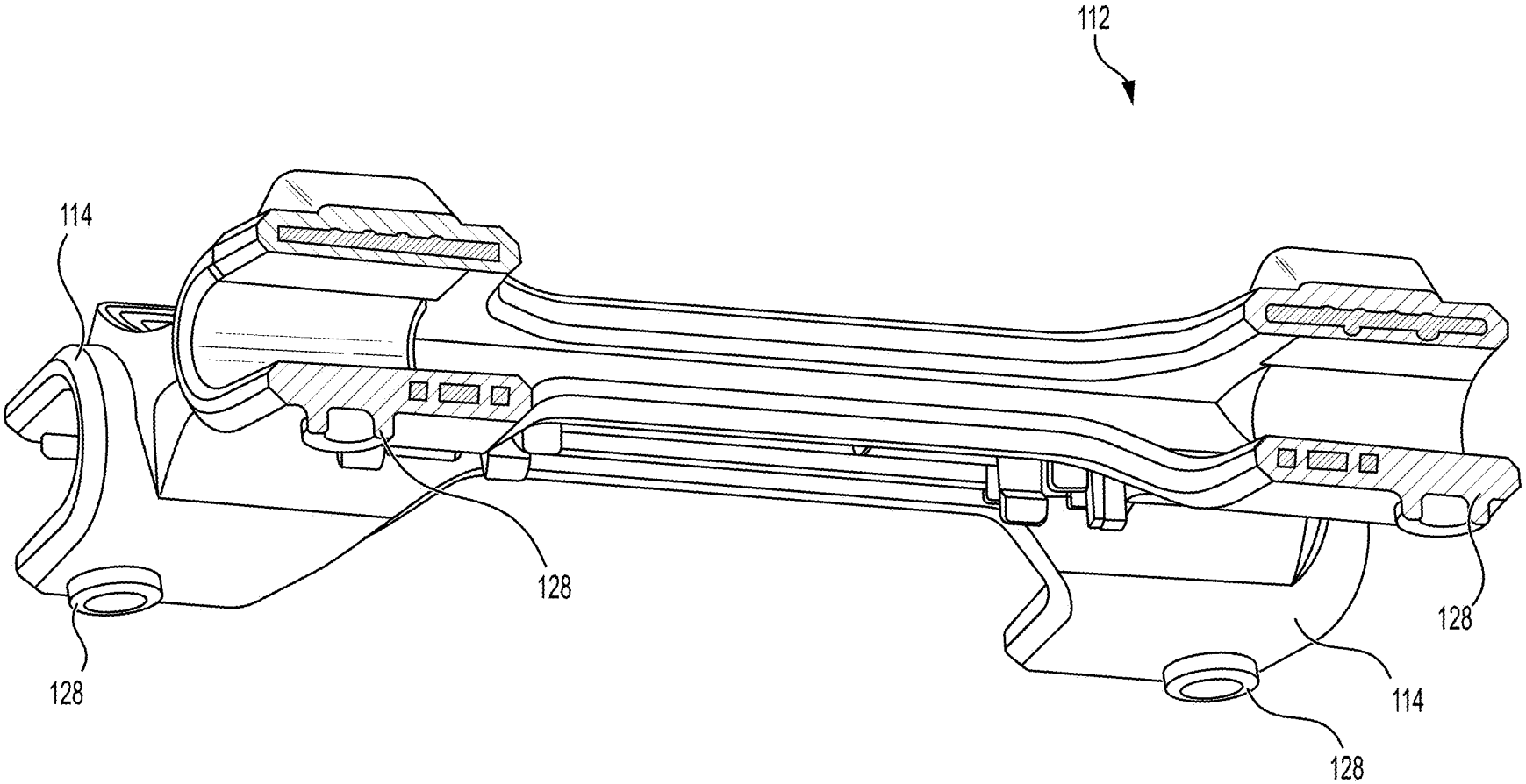
FIG. 10 depicts a cross-sectional view of a housing base for a portable air pump and inflator system, in accordance with some embodiments.

As shown in FIG. 9, the housing base 112 includes a rigid base portion 400 that attaches to the base of the portable air pump and inflator system 100, for example as shown in FIGS. 1-8. The rigid base portion 400 may, for example, be made from a rigid material, such as plastic, that is over-molded with a less rigid material 410 (e.g., rubber), as shown. The housing base 112 may further include a receiving portion that is configured to accommodate the bottom portion of the compressor housing 110. In the example shown in FIG. 10, the receiving portion is curved to receive the rounded bottom portion of the compressor housing 110. However, in some examples other shapes may be used for both the receiving portion of the housing base 112 and the bottom portion of the compressor housing 110.

Figure 11:
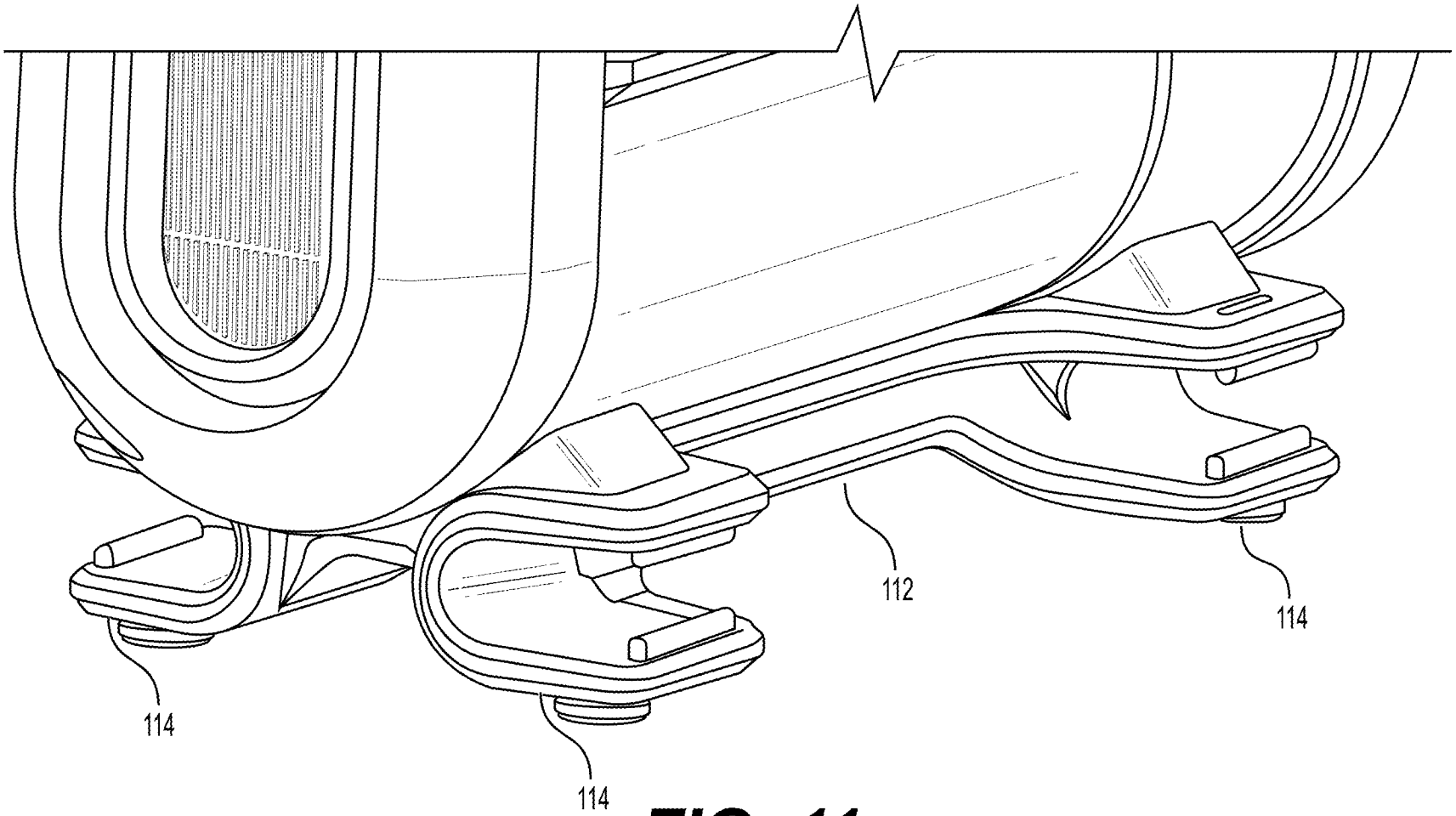
FIG. 11 depicts a portable air pump and inflator system with a housing base, in accordance with some embodiments.

In addition, the housing base 112 includes a plurality of flexible foot extensions 114 that extend from the rigid base portion and are configured to support the portable air pump and inflator system 100 on a surface to dampen vibrations caused by operation of the electric air compressor. As shown in FIG. 11, the flexible foot extensions 114 may be substantially U-shaped and may extend laterally from the compressor housing 110 when the compressor housing 110 is attached to the housing base 112. Furthermore, the flexible foot extensions 114 may include an inner portion with one or more ridges.

Figure 12:
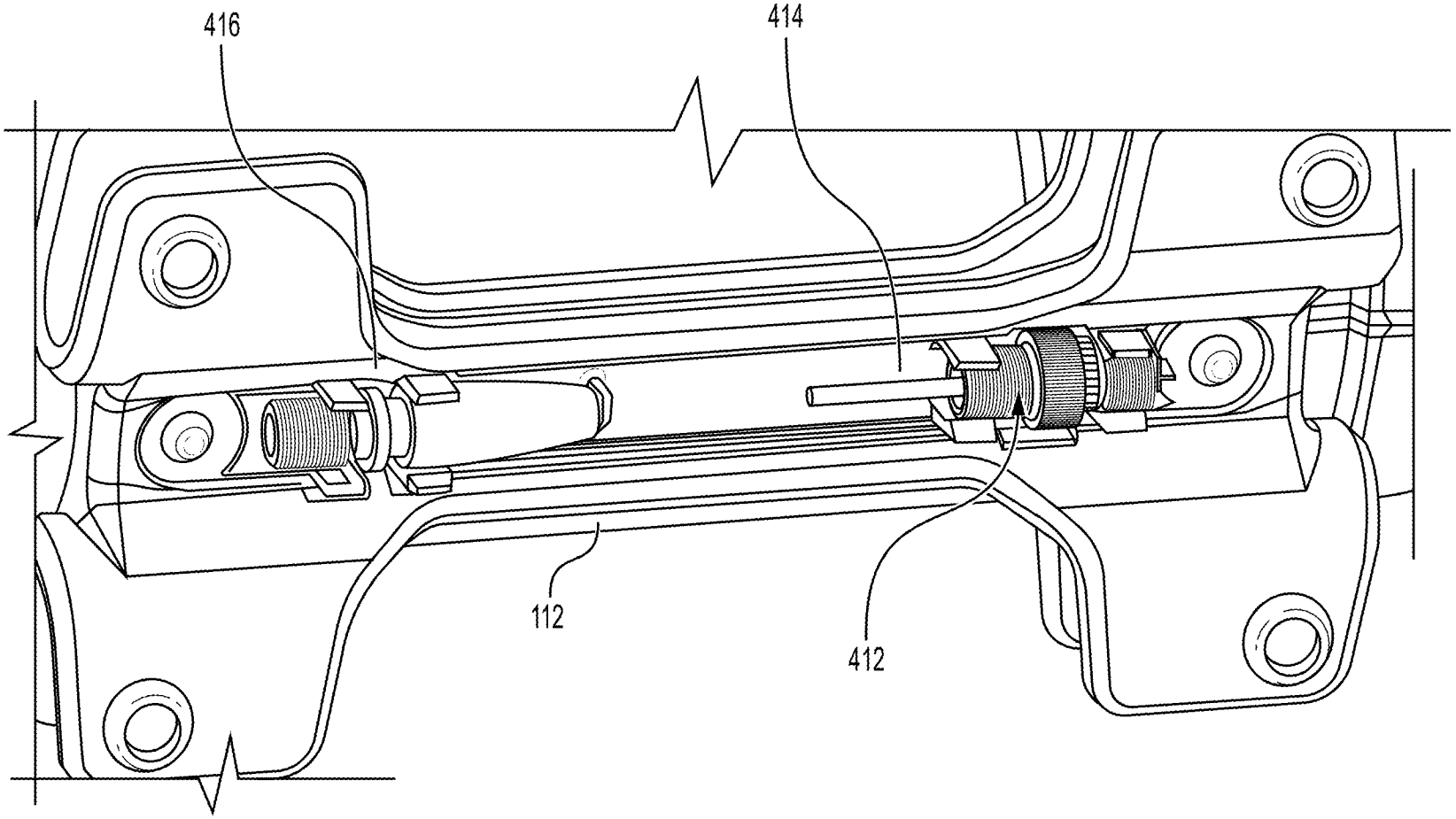
FIG. 12 depicts a bottom view of a housing base for a portable air pump and inflator system, in accordance with some embodiments.

FIG. 12 shows a cross-sectional view of the housing base 112, which illustrates that the plurality of flexible foot extensions 114 may be formed by removing the plastic substrate from portions of the over-molded housing base 112 that will make contact with the ground. Removing the plastic substrate from these portions of the housing base 112 may ensure that the less-rigid material (e.g., rubber) makes contact with the surface on which it is mounted, thus damping vibrations realized by the portable air pump and inflator system 100 during operation. Moreover, a bottom of the flexible foot extensions 114 may include a plurality of (e.g., four) damping feet 128 that make contact with the surface during operation of the portable air pump and inflator system 100. The damping feet 128 may provide a space between the housing base 112 and the surface on which the portable air pump and inflator system 100 is mounted to prevent damage to the housing base 112 due to, for example, scraping caused by vibrations.

The housing base 112 may also provide an area to wrap the air hose 120 for storage (as shown for example in FIG. 8). As shown, the rigid base portion and the flexible foot extensions 114 of the housing base 112 may be configured to define slots into which an air hose may be inserted to wrap around the portable air pump and inflator system. As shown in FIGS. 9 and 11, the edges on the inner portions of the flexible foot extensions 114 may retain the air hose 120 during storage to prevent the air house 120 from inadvertently becoming unwound. As illustrated in FIG. 12, embodiments of the base 112 may also include snap features to store nozzle accessories, such as for example, a presta valve adaptor 412, a ball inflator adaptor 414, and/or an inflatable raft/toy adaptor 416.

Pressure Relief System

Figure 13B:
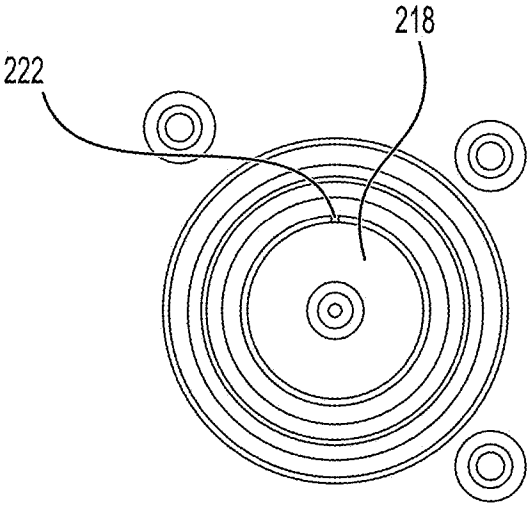
FIG. 13B depicts a cross-sectional view of a piston with a relief channel, in accordance with some embodiments.
Figure 13C:
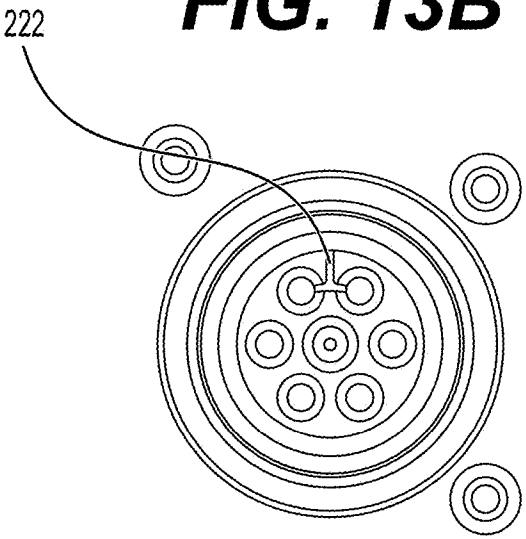
FIG. 13C depicts another view of a cross-section of a piston with a relief channel, in accordance with some embodiments.
Figure 13A:
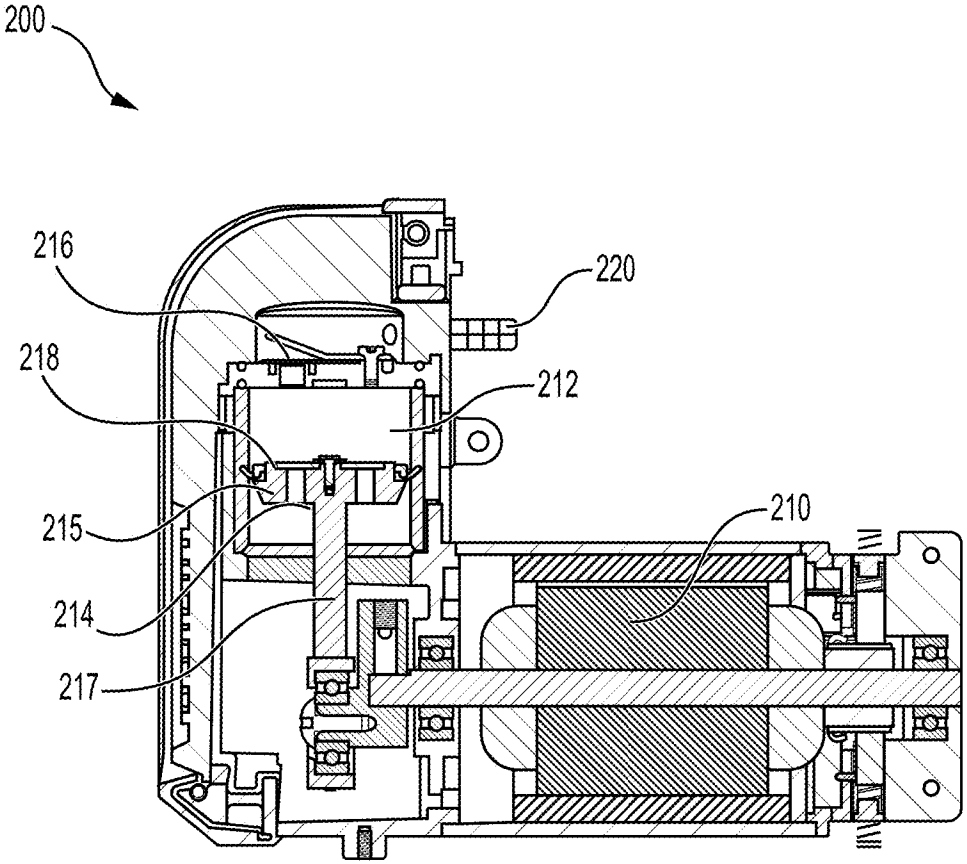
FIG. 13A depicts a cross-sectional view of a pressure relief system for a portable air pump and inflator system, in accordance with some embodiments.

FIG. 13A depicts a cross-sectional view of a pressure relief system for a portable air pump and inflator system, in accordance with some embodiments. The example pressure relief system 200 may, for example, be included in the portable air pump and inflator system 100 shown in FIGS. 1-8. As shown in FIG. 13A, the portable air pump pressure relief system 200 includes an electric motor 210, a piston cylinder 212, a piston 214, and a reed valve 216. The piston 214 includes a piston head 215 that is driven by a piston rod 217 attached to the electric motor 210. The piston head 215 includes a piston valve 218 that is configured to allow air to enter the piston cylinder 212 on a down-stroke of the piston 214. On an up-stroke of the piston 214, the reed valve 216 is configured to allow air forced by the piston head 215 to pass from the piston cylinder 212 to an air outlet 220 for inflating an inflatable object (such as a tire, ball, etc.).

FIGS. 13B and 13C depict cross-sectional views of a piston with a relief channel, in accordance with some embodiments. When the portable air pump and inflator system 100 finishes filling an inflatable object and the motor 210 shuts off, an issue can arise in which the reed valve 216 does not close quickly enough to prevent backpressure from filing the cylinder 212 between the reed valve 216 and piston valve 218. If the pressure is great enough (e.g., greater than a predetermined level), the next time the portable air pump and inflator system 100 is started a fuse may blow due to a large inrush of current as the motor 210 is almost in a stall condition. To prevent this, a small relief channel 222 may be added to the piston 214 underneath the piston valve 218, as shown in FIGS. 13B and 13C. The relief channel 222 defines an opening through the piston head 215 to allow air to escape from within the piston cylinder 212, thus lowering the air pressure within the piston cylinder 212.

Accordingly, the relief channel 222 may prevent the piston cylinder 212 from being pressurized, even when the reed valve 216 does not close quickly enough. Moreover, the relief channel 222 may effectively relieve pressure from within the piston cylinder 212 even when electronics within the portable air pump and inflator system 100 are malfunctioning. As shown in FIG. 13B, the relief channel 222 may protrude slightly from underneath the piston valve 218. As shown in the illustrated embodiment, the relief channel 222 may, for example, connect two of the piston holes underneath the piston valve 218 to the outside of the valve to allow air to escape.

Display

Figure 14A:
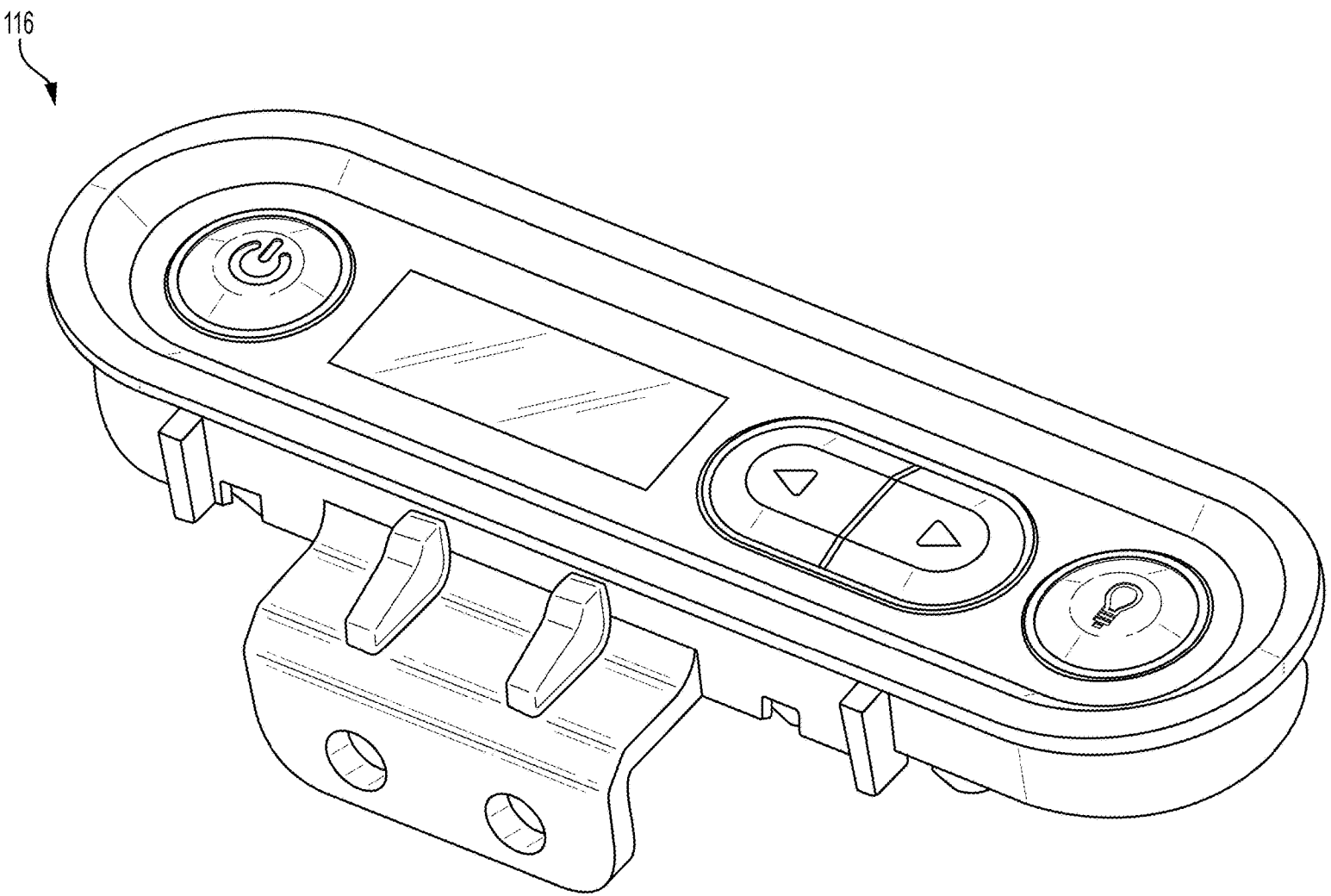
FIG. 14A depicts a perspective view of a display for a portable air pump and inflator system, in accordance with some embodiments.
Figure 14B:
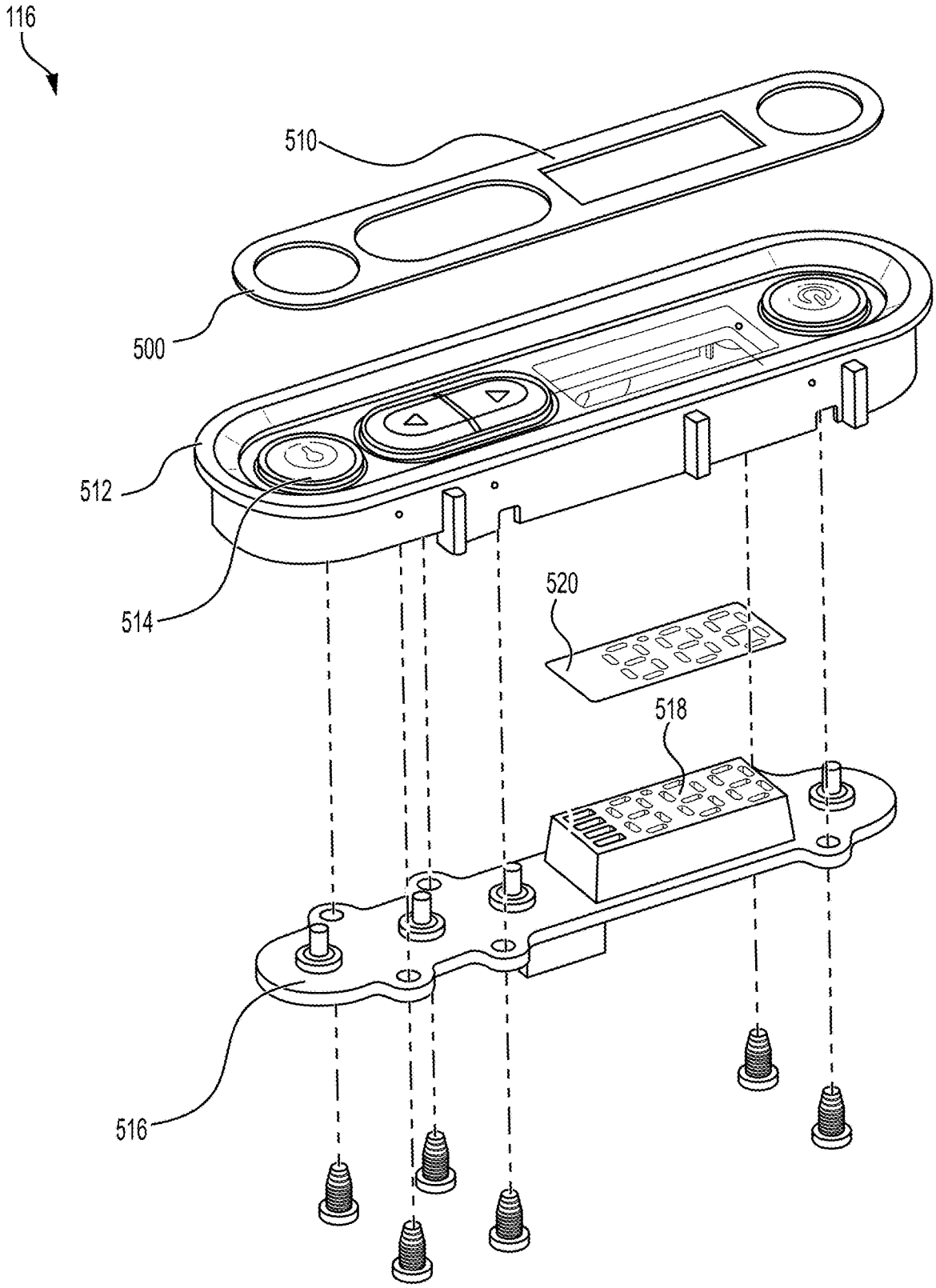
FIG. 14B depicts an exploded view of a display for a portable air pump and inflator system, in accordance with some embodiments.

FIGS. 14A and 14B illustrate an example display 116 for a portable air pump and inflator system. The display 116 may, for example, be utilized in the portable air pump embodiment shown in FIGS. 1-8. The illustrated display 116 is designed to appear completely black in the LED area when the unit is off and then only the necessary segments are visible when the unit is powered on. As shown in the exploded view of FIG. 14B, the display 116 may include an overlay label 500 with a translucent display window 510 that is overlaid onto a plastic housing 512. The display may include a plurality of user input buttons 514, for example silicone buttons that are compression molded into the plastic housing 512. A display printed circuit board 516 having an LED display with an LED light pipe 518 and a light diffuser 520 may be mounted in the plastic housing 512 to provide a user interface display.

It will be appreciated by those skilled in the art that changes could be made to the embodiments described above without departing from the broad inventive concept thereof. It is understood, therefore, that the invention disclosed herein is not limited to the particular embodiments disclosed, and is intended to cover modifications within the spirit and scope of the present invention.

What is claimed is:

1. A portable air pump and inflator system, comprising:
- an electric air compressor;
- a compressor housing enclosing the electric air compressor;
- an air hose attached or attachable to an air outlet of the electric air compressor; and
- a housing base attached to the compressor housing, the housing base comprising
  - a rigid base portion that is attached to the compressor housing, and
  - a plurality of first flexible foot extensions that are substantially U-shaped and extend laterally from the rigid base portion in a first direction; and
  - a plurality of second flexible foot extensions that are substantially U-shaped and extend laterally from the rigid base portion in a second direction away from the first direction, the first and second flexible foot extensions configured to support the portable air pump and inflator system on a surface, wherein the first and second flexible foot extensions dampen vibrations caused by operation of the electric air compressor, wherein the rigid base portion and the first and second flexible foot extensions are configured to define slots into which the air hose may be inserted to wrap around the portable air pump and inflator system, wherein the housing base is at a bottom of the portable air pump and inflator system when the portable air pump and inflator system is in an upright position.

2. The portable air pump and inflator system of claim 1, wherein the plurality of first and second flexible foot extensions are comprised of rubber.

3. The portable air pump and inflator system of claim 2, wherein the rigid base portion is rubber over-molded plastic.

4. The portable air pump and inflator system of claim 3, wherein the housing base comprises rubber over-molded plastic, and the first and second flexible foot extensions are portions of the housing base without a plastic substrate.

5. The portable air pump and inflator system of claim 1, wherein the first and second flexible foot extensions include a plurality of damping feet configured to contact the surface during operation of the portable air pump and inflator system.

6. The portable air pump and inflator system of claim 5, wherein the plurality of damping feet are further configured to provide a space between the surface and the housing base.

7. The portable air pump and inflator system of claim 1, wherein an inner portion of the first and second flexible foot extensions include one or more ridges configured to retain the air hose.

8. The portable air pump and inflator system of claim 1, wherein the housing base includes a receiving portion configured to receive a bottom of the compressor housing.

9. The portable air pump and inflator system of claim 1, wherein the housing base includes one or more snap features configured to store a nozzle accessory.

10. A housing base for a portable air pump and inflator system, the housing base comprising:

a rigid base portion that is attached to or attachable to a compressor housing, and a plurality of first flexible foot extensions that are substantially U-shaped and extend laterally from the rigid base portion in a first direction; and a plurality of second flexible foot extensions that are substantially U-shaped and extend laterally from the rigid base portion in a second direction away from the first direction, the first and second flexible foot extensions configured to support the portable air pump and inflator system on a surface, the first and second flexible foot extensions defining slots into which an air hose of the portable air pump and inflator system may be inserted, wherein inner portions of the first and second flexible foot extensions include one or more ridges configured to retain the air hose; wherein the first and second flexible foot extensions dampen vibrations caused by operation of the portable air pump and inflator system, wherein the housing base is configured to be positioned at a bottom of the portable air pump and inflator system when the portable air pump and inflator system is in an upright position.

11. The housing base for the portable air pump and inflator system of claim 10, wherein the plurality of first and second flexible foot extensions are comprised of rubber.

12. The housing base for the portable air pump and inflator system of claim 11, wherein the rigid base portion is rubber over-molded plastic.

13. The housing base for the portable air pump and inflator system of claim 12, wherein the housing base comprises rubber over-molded plastic, and the first and second flexible foot extensions are portions of the housing base without a plastic substrate.

14. The housing base for the portable air pump and inflator system of claim 10, wherein the first and second flexible foot extensions include a plurality of damping feet configured to contact the surface during operation of the portable air pump and inflator system.

15. The housing base for the portable air pump and inflator system of claim 14, wherein the plurality of damping feet are further configured to provide a space between the surface and the housing base.

16. The housing base for the portable air pump and inflator system of claim 10, wherein the housing base includes one or more snap features configured to store a nozzle accessory.

* * * * *